US007140155B1

(12) United States Patent
Nasimov

(10) Patent No.: US 7,140,155 B1
(45) Date of Patent: Nov. 28, 2006

(54) JOINTS FOR CONSTRUCTING A SHEAR WALL

(76) Inventor: Robert Nasimov, 64-07 102nd St., Rego Park, NY (US) 11374

( * ) Notice: Subject to any disclaimer, the term of this patent is extended or adjusted under 35 U.S.C. 154(b) by 12 days.

(21) Appl. No.: 10/662,670

(22) Filed: Sep. 15, 2003

(51) Int. Cl.
*E04B 1/38* (2006.01)
*E04H 1/04* (2006.01)
*E04H 9/14* (2006.01)

(52) U.S. Cl. ..... 52/236.8; 52/251

(58) Field of Classification Search ..... 52/236.7, 52/236.8, 236.9, 167.3, 241, 251, 253
See application file for complete search history.

(56) References Cited

U.S. PATENT DOCUMENTS

| | | | | | |
|---|---|---|---|---|---|
| 2,883,852 | A | * | 4/1959 | Midby | 52/236.8 |
| 3,494,092 | A | * | 2/1970 | Bottjer et al. | 52/236.7 |
| 3,566,560 | A | * | 3/1971 | Wakefield et al. | 52/236.7 |
| 3,796,017 | A | * | 3/1974 | Meckler | 52/167.3 |
| 3,834,095 | A | * | 9/1974 | Ohlson | 52/236.8 |
| 3,963,210 | A | | 6/1976 | Macklin | |
| 4,530,194 | A | | 7/1985 | Linton et al. | |
| 4,697,398 | A | * | 10/1987 | Granieri | 52/236.8 |
| 4,716,695 | A | * | 1/1988 | Alexander et al. | 52/167.3 |
| 4,750,306 | A | * | 6/1988 | Granieri | 52/251 |
| 4,875,314 | A | * | 10/1989 | Boilen | 52/236.7 |
| 5,375,384 | A | | 12/1994 | Wolfson | |
| 5,402,612 | A | * | 4/1995 | diGirolamo et al. | 52/241 |
| 5,669,194 | A | * | 9/1997 | Colasanto et al. | 52/236.8 |
| 5,913,788 | A | * | 6/1999 | Herren | 52/241 |
| 6,009,677 | A | * | 1/2000 | Anderson | 52/251 |
| 6,148,583 | A | | 11/2000 | Hardy | |
| 6,308,469 | B1 | * | 10/2001 | Leung | 52/167.3 |
| 6,389,778 | B1 | * | 5/2002 | Strange | 52/241 |
| 2002/0020136 | A1 | | 2/2002 | Mueller | |
| 2002/0066247 | A1 | | 6/2002 | Leek | |

* cited by examiner

*Primary Examiner*—Michael Safavi
(74) *Attorney, Agent, or Firm*—Richard L. Miller

(57) ABSTRACT

Joints for constructing a shear wall. The joints include a least an intermediate base joint, and a combination ceiling and floor joint. Each joint includes a bracket, a track wall, an optional base late, a stud, and at least two diagonal braces. The bracket is integrally formed with the shear wall, attached the shear wall to a substrate and prevents uplift of the shear wall. The bracket includes a base from which a pair of side walls upwardly extend. The track wall includes a base from which a pair of side walls upwardly extend, functions as sole and top plates, and sits attachingly in the bracket. The stud extends attachingly from the bracket. The optional base plate, when present, sits attachingly in the bracket and distributes load of the stud. The at least two diagonal braces extend attachingly diagonally outwardly from the pair of side walls of the bracket, respectively.

15 Claims, 3 Drawing Sheets

JOINTS FOR CONSTRUCTING A SHEAR WALL

BACKGROUND OF THE INVENTION

1. Field of the Invention

The present invention relates to joints for a wall. More particularly, the present invention relates to joints for constructing a shear wall.

2. Description of the Prior Art

Numerous innovations for wall brackets have been provided in the prior art that will be described. Even though these innovations may be suitable for the specific individual purposes to which they address, however, they differ from the present invention.

A FIRST EXAMPLE U.S. Pat. No. 3,963,210 Macklin teaches disclosed is a support for use in setting anchor bolts, and the like, in a monolithic poured concrete slab and the method of using the same. The support has a plate with a plurality of elongate legs extending from one side thereof. A wooden block is attached to the other side of the plate by nails extending through bores in the plate. A template is provided with a plurality of bores of a size to receive anchor bolt assemblies therein. The bores in the template have a spacial relationship according to the desired location of the anchor bolts in the slab. A central referencing hole is provided in the center of the template for releasably attaching the template to the upper surface of the wooden block during the installation procedure. To use the apparatus, the legs of the support are first embedded in the subsoil of the slab before the slab is cast. The upper surface of the block is leveled in position at a desired height. A nail is inserted in the wooden block at the theoretical center of the column. Concrete is poured in the area around the support. Next, the template is positioned with the referencing hole over the finishing nail and the anchor bolts are forced down into the concrete. The concrete is allowed to set and the template and wooden block are then removed leaving the anchor bolts in the correct position for attaching the column.

A SECOND EXAMPLE U.S. Pat. No. 4,530,194 Linton et al. teaches a bracket for use at a node point in a framework between two horizontal members and vertical member, said bracket comprising a first channel member having a base and two upstanding sides walls, the longitudinal axis of which is aligned with the axis of said two horizontal members, said channel member being provided with means defining two transverse partition walls defining a space within the first channel member intermediate the ends thereof for accommodating the base of the substantially vertical member, and defining spaces between the partition walls and the ends of the channel to accommodate the ends of the horizontal members, a further element being provided for mounting said channel member on a sub-structure.

A THIRD EXAMPLE U.S. Pat. No. 4,875,314 Boilen teaches a structural connection system for resisting uplift loads on the shear walls for each level of a wood frames structure includes anchors for each level. The system, employed at least at the lateral ends of the shear walls, compressively restrains the shear wall against upward movement. The anchors, which are vertically aligned, are coupled to one another through tie rods. A tie rod connects the anchor for the bottom floor to a foundation anchor embedded in the foundation. The anchors and tie rods are positioned between pairs of closely spaced vertical framing elements, such as studs. Uplift loads for each level are transferred to the foundation through the connection system. This eliminates any accumulation of uplift loads from level to level.

A FOURTH EXAMPLE U.S. Pat. No. 5,375,384 Wolfson teaches a hold down apparatus is provided for securing a shear wall to a concrete base. The apparatus includes an upright tie member and a cooperating anchoring member. The upright tie member has (1) a tubular base, (2) a pair of spaced, upstanding anchoring plates mounted to the base and adapted to received post, preferably an end post, of the shear wall and (3) a plurality of fasteners for extending through the anchoring plates and the post. The anchoring member includes a plate, a fastener for the upright tie member secured to the plate and a pair of support legs for the plate.

A FIFTH EXAMPLE U.S. Pat. No. 6,148,583 Hardy teaches the reinforcing brace frame is utilized in building walls as a complete system of protection against both the severe shear stress and uplifting encountered during tornadoes, hurricanes and earthquakes. The reinforcing brace frame includes two vertically-spaced horizontally extending frame members joined at their opposite lends to two horizontally-spaced vertically extending frame members, and a diagonal member rigidly connected to opposite ends of the horizontally extending frame members. The reinforcing brace frame can also include spaced vertical support members between the vertical frame members. The reinforcing brace frame is directly attached to a concrete foundation by shear bolts and hold down bolts. Consequently, the reinforcing brace frame provides increased resistance against simultaneous shear stress and uplifting, eliminating the need for plywood shear panels.

A SIXTH EXAMPLE U.S. Patent Application Pub. No. U.S. 2002/0020136 A1 to Mueller teaches a two-piece bracket adapted to resist forces in both tension and compression. The tension/compression bracket is formed from stamped, plate steel and is preassembled by clinching. The tension/compression bracket provides a range of adjustability of attachment to allow for a limited range of placement of other components that attach to the tension/compression bracket. In one embodiment, the tension/compression bracket includes a resilient resistance to tension forces. The resilient resistance is provided by a high spring constant coil spring. The resilient resistance provides a limited degree of movement under tension. The limited degree of movement is chosen by component selection to be non-damaging.

A SEVENTH EXAMPLE U.S. Patent Application Pub. No. U.S. 2002/0066247 A1 to Leek teaches a connector for attaching a first building structural member to a second building structural member in conjunction with fasteners and an anchor member to resist forces on buildings imposed by earthquakes, hurricanes, tornadoes and other similar cataclysmic forces is made with a strap and a standoff base. The standoff base receives the anchor member, and bears upon the strap. The strap is connected the first building structural member by means of the fasteners. The first building structural member bears upon the standoff base while being lifted above the anchor member by the standoff base.

It is apparent that numerous innovations for wall brackets have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide joints for constructing a shear wall that avoids the disadvantages of the prior art.

ANOTHER OBJECT of the present invention is to provide joints for constructing a shear wall that is simple to use.

BRIEFLY STATED, STILL ANOTHER OBJECT of the present invention is to provide a joints for constructing a shear wall. The joints include a least an intermediate base joint, and a combination ceiling and floor joint. Each joint includes a bracket, a track wall, an optional base late, a stud, and at least two diagonal braces. The bracket is integrally formed with the shear wall, attached the shear wall to a substrate and prevents uplift of the shear wall. The bracket includes a base from which a pair of side walls upwardly extend. The track wall includes a base from which a pair of side walls upwardly extend, functions as sole and top plates, and sits attachingly in the bracket. The stud extends attachingly from the bracket. The optional base plate, when present, sits attachingly in the bracket and distributes load of the stud. The at least two diagonal braces extend attachingly diagonally outwardly from the pair of side walls of the bracket, respectively.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

Figure 1:
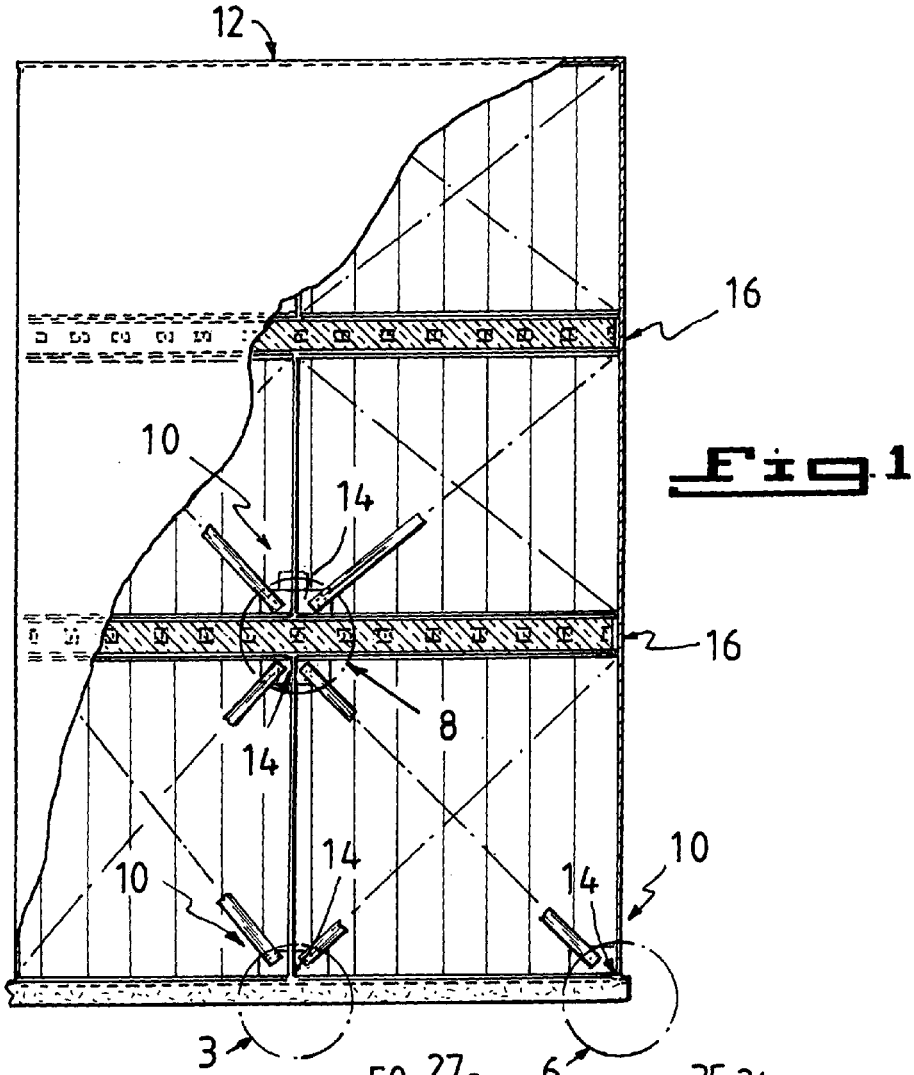
FIG. 1 is a diagrammatic elevational view of a shear wall utilizing joints of the present invention.

| | |
|---|---|
| 10 | joints of present invention for constructing shear wall 12 |
| 12 | shear wall |

-continued

| | |
|---|---|
| 14 | bracket |
| 16 | substrate |
| 18 | base of bracket 14 for abutting against substrate 16 |
| 20 | pair of side walls of bracket 14 |
| 22 | pair of longitudinal edges of base 18 of bracket 14 |
| 24 | pair of through bores in base 18 of bracket 14 for use in affixing bracket 14 to substrate 16 |
| 26 | plurality of through bores in each side wall of pair of side walls 20 of bracket 14 |
| 27 | typical joint |
| 28 | track wall |
| 30 | base of track wall 28 |
| 32 | pair of side walls of track wall 28 |
| 34 | pair of longitudinal edges of base 30 of track wall 28 |
| 35 | pair of through bores in base 30 of track wall 28 |
| 36 | base plate |
| 38 | pair of through bores in base plate 36 |
| 40 | stud |
| 42 | end of stud 40 |
| 44 | at least two diagonal braces |
| 46 | end of each brace of at least two diagonal braces 44 |
| 48 | plurality of through bores in end 46 of each brace of at least two diagonal braces 44 |
| 50 | intermediate base joint |
| 52 | concrete foundation of substrate 16 |
| 54 | pair of anchor bolts |
| 56 | pair of nuts |
| 58 | end base joint |
| 60 | ceiling and floor joint |
| 62 | upper header of substrate 16 |
| 64 | lower header of substrate 16 |
| 66 | floor joists of substrate 16 |
| 68 | stud of substrate 16 |
| 70 | pair of through bores in upper header 62 of substrate 16 |
| 72 | pair of through bores in lower header 64 of substrate 16 |
| 74 | pair of through bolts |

DETAILED DESCRIPTION OF THE PREFERRED EMBODIMENT

Referring now to the figures, in which like numerals indicate like parts, and particularly to FIG. 1, the joints of the present invention are shown generally at 10 for constructing a shear wall 12.

Each of the joints 10 comprises a bracket 14. The bracket 14 is integrally formed with the shear wall 12, attaches the shear wall 12 to a substrate 16, and prevents uplift of the shear wall 12.

Figure 2:
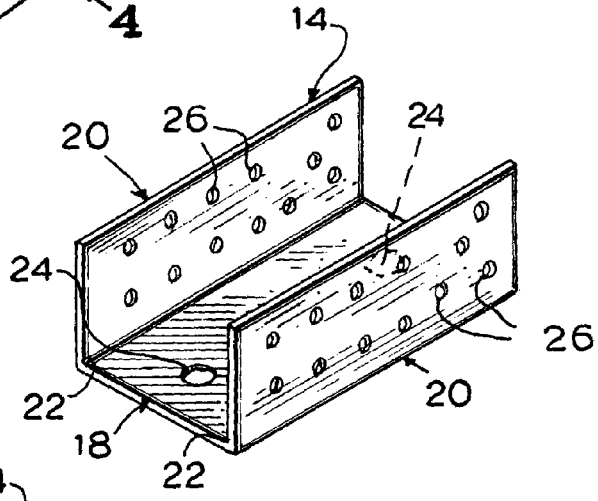
FIG. 2 is a diagrammatic perspective view of the bracket utilized to construct the joints of the present invention.

The specific configuration of the bracket 14 can best be seen in FIG. 2, and as such, will be discussed with reference thereto.

The bracket 14 consists of a base 18 and a pair of side walls 20. The base 18 of the bracket 14 is for abutting against the substrate 16 and has a pair of longitudinal edges 22 from which the pair of side walls 20 of the bracket 14 upwardly extend, respectively, so as to allow the bracket 14 to have a generally and substantially U-shape in lateral cross section.

The base 18 of the bracket 14 has a pair of through bores 24 and each side wall 20 of the bracket 14 has a plurality of through bores 26. The pair of through bores 24 in the base 18 of the bracket 14 are for use in affixing the bracket 14 to the substrate 16.

The specific configuration of a typical joint 27 of the present invention can best be seen in FIGS. 3–5, and as such, will be discussed with reference thereto.

The typical joint 27 comprises a track wall 28. The track wall 28 functions as a sole plate and a top plate and consists of a base 30 and a pair of side walls 32. The base 30 of the track wall 28 has a pair of longitudinal edges 34 from which the pair of side walls 32 of the track wall 28 upwardly extend, respectively, so as to allow the track wall 28 to have a generally and substantially U-shape in lateral cross section, and a pair of through bores 35 that align with the pair of through bores 24 in the base 18 of the bracket 14.

The track wall 28 sits in the bracket 14, with the base 30 of the track wall 28 abutting against the base 18 of the bracket 14, and with the side walls 32 of the track wall 28 abutting against the side walls 20 of the bracket 14, respectively, so as to allow the bracket 14 to capture the track wall 28.

The typical joint 27 further comprises a base plate 36. The base plate 36 sits in the bracket 14, abuts against the base 30 of the track wall 28, and has a pair of through bores 38 that align with the pair of through bores 24 in the base 30 of the track wall 28, respectively.

The typical joint 27 further comprises a stud 40. The stud 40 extends from the bracket 14 and has an end 42 that abuts against, and is affixed to, the pair of side walls 20 of the bracket 14, abuts against the base 30 of the track wall 28 when the base plate 36 is not present so as to allow the track wall 28 to distribute the load of the stud 40 to the bracket 14, and abuts against the base plate 36 when the base plate 36 is present so as to allow the base plate 36 to distribute the load of the stud 40 to the track wall 28 and ultimately to the bracket 14.

The typical joint 27 further comprises at least two diagonal braces 44. Each of the at least two diagonal braces 44 is flat, extends diagonally outwardly from the bracket 14, abuts against, and is affixed to, a respective side wall 20 of the bracket 14, and has an end 46 with a plurality of through bores 48.

The plurality of through bores 48 in the end 46 of each of the at least two diagonal braces 44 align with corresponding through bores 26 in the respective side wall 20 of the bracket 14.

Figure 5:
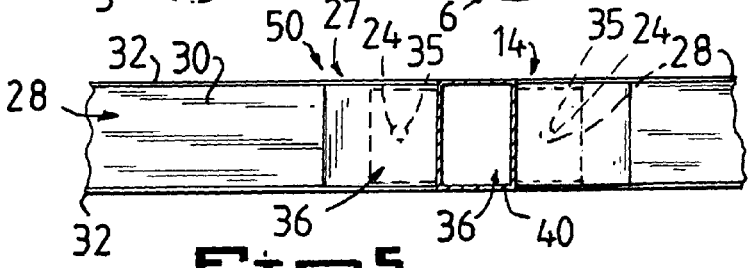
FIG. 5 is a diagrammatic top plan view taken generally in the direction of arrow 5 in FIG. 3.
Figure 3:
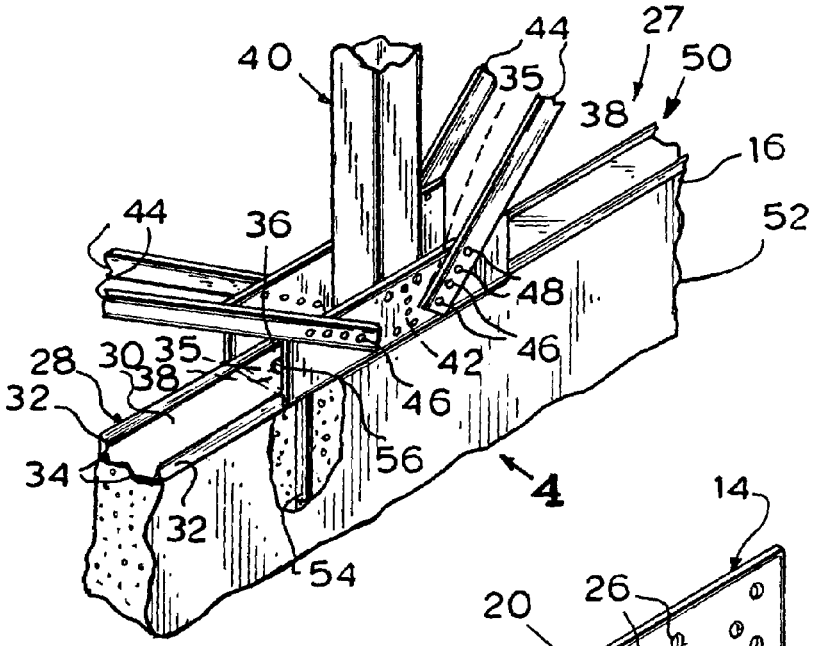
FIG. 3 is an enlarged diagrammatic perspective view of the area generally enclosed by the dotted curve identified by arrow 3 in FIG. 1 of a intermediate base joint of the present invention utilizing the bracket shown in FIG. 2.
Figure 4:
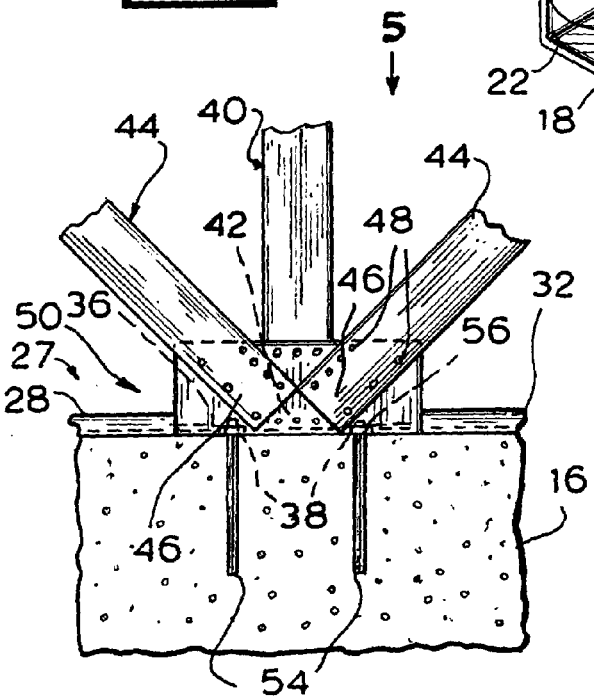
FIG. 4 is a diagrammatic elevational view taken generally in the direction of arrow 4 in FIG. 3.

Even though FIGS. 3–5 have been utilized to depict the typical joint 27, FIGS. 3–5 also specifically depict an intermediate base joint 50.

In constructing the intermediate base joint 50, the substrate 16 is a concrete foundation 52, the track wall 28 extends outwardly from both ends of the base 18 of the bracket 14, the pair of through bores 24 in the base 18 of the bracket 14, the pair of through bores 35 in the base 30 of the track wall 28, and the pair of through bores 38 in the base plate 36 receive a pair of anchor bolts 54 extending upwardly out of the concrete foundation 52 that ultimately receive a pair of nuts 56, respectively, the stud 48 extends centrally upwardly from the base plate 36 so as to be straddled by the pair of nuts 56, and the at least two diagonal braces 44 are four, a pair of each extending from each side wall 20 of the bracket 14, diagonally outwardly in opposite directions.

Figure 7:
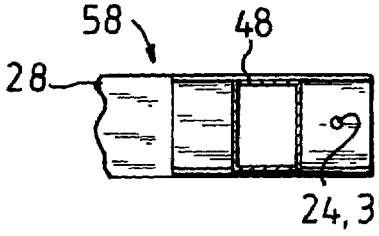
FIG. 7 is a diagrammatic top plan view taken generally in the direction of arrow 7 in FIG. 6.
Figure 6:
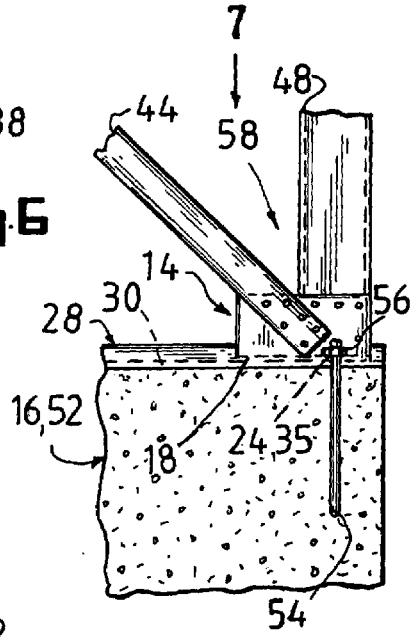
FIG. 6 is an enlarged diagrammatic perspective view of the area generally enclosed by the dotted curve identified by arrow 6 in FIG. 1 of a base corner joint of the present invention utilizing the bracket of the present invention shown in FIG. 2.

Another joint is that of an end base joint 58, which can best be seen in FIGS. 6 and 7, and as such, will be discussed with reference thereto.

In constructing the end base joint 58, the substrate 16 is the concrete foundation 52, the track wall 28 extends outwardly from one end of the base 18 of the bracket 14, only an outermost one of the pair of through bores 24 in the base 18 of the bracket 14, an aligned one of the pair of through bores 35 in the base 30 of the track wall 28, and an aligned one of the pair of through bores 38 in the base plate 36 receive the anchor bolt 54 extending upwardly out of the concrete foundation 52 that ultimately receives a nut 56, the stud 48 extends upwardly from an outermost end of the base plate 36, and the at least two diagonal braces 44 extend diagonally inwardly.

Figure 8:
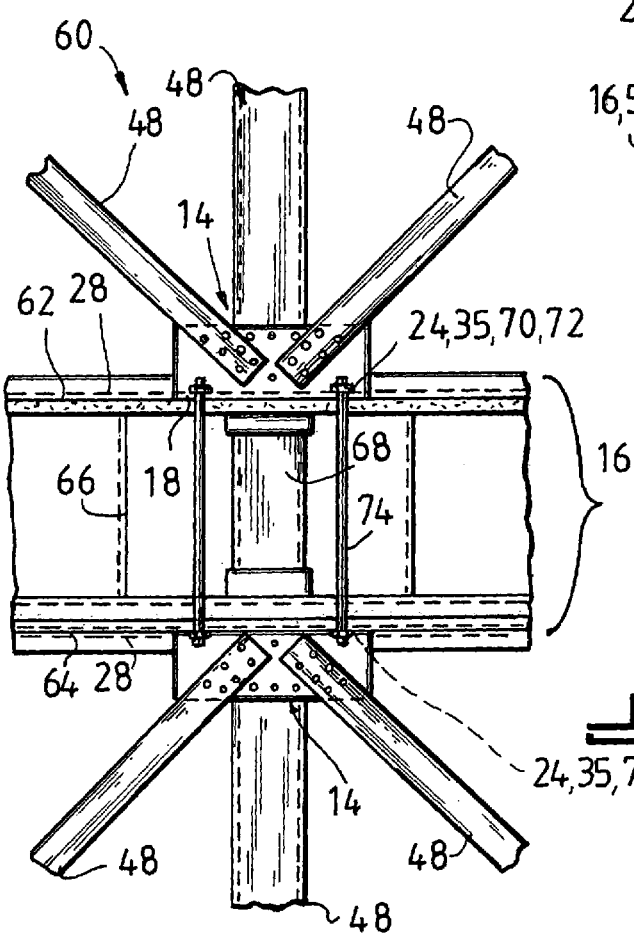
FIG. 8 is an enlarged diagrammatic perspective view of the area generally enclosed by the dotted curve identified by arrow 8 in FIG. 1 of a ceiling and floor joint of the present invention utilizing the bracket of the present invention shown in FIG. 2.

Another joint is that of a ceiling and floor joint 60, which can best be seen in FIG. 8, and as such, will be discussed with reference thereto.

In constructing the ceiling and floor joint 60, the substrate 16 is an upper header 62 and a lower header 64 that are spaced-apart by floor joists 66 and a stud 68, two brackets 14 are utilized, the base 18 of one bracket 14 is for abutting against the upper header 62, the base 18 of the other bracket 14 is for abutting against the lower header 64 and is in alignment with the one bracket 14, two track walls 28 are utilized, one track wall 28 extends outwardly from both ends of the base 18 of the one bracket 14, the other track wall 28 extends outwardly from both ends of the base 18 of the other bracket 14, the pair of through bores 24 in the base 18 of the one bracket 14, the through bores 35 in the base 30 of the one track wall 28, a pair of through bores 70 in the upper header 62, a pair of through bores 72 in the lower header 64, the pair of through bores 24 in the base 18 of the other bracket 14, and the pair of through bores 35 in the base 30 of the other track wall 28 receive a pair of through bolts 74, two studs 48 are utilized, one stud 48 extends centrally upwardly from the base 30 of the one track wall 28 so as to be straddled by the pair of through bolts 74 and aligned with the stud 68 of the substrate 16, the other stud 48 depends centrally from the base 30 of the other track wall 28 so as to be straddled by the pair of through bolts 74 and be aligned with the stud 68 of the substrate 16, and the at least two diagonal braces 44 are eight, a pair of each extend from each side wall 20 of each bracket 14, diagonally outwardly in opposite directions.

It will be understood that each of the elements described above, or two or more together, may also find a useful application in other types of constructions differing from the types described above.

While the invention has been illustrated and described as embodied in joints for constructing a shear wall, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. Joints for constructing a shear wall, comprising:

a bracket;

wherein said bracket is integrally formed with said shear wall;

wherein said bracket is for attaching said shear wall to a substrate; and wherein said bracket is for preventing uplift of said shear wall, wherein said bracket consists of:

a) a base; and b) a pair of side walls;

wherein said base of said bracket is for abutting against the substrate;

wherein said base of said bracket has a pair of longitudinal edges; and wherein said pair of side walls of said bracket extend upwardly from said pair of longitudinal edges of said base of said bracket, respectively, so as to allow said bracket to have a generally and substantially U-shape in lateral cross section, wherein each side wall of said bracket has a plurality of through bores; further comprising a track wall;

wherein said track wall consists of:

A) a base; and

B) a pair of side walls;

wherein said base of said track wall has a pair of longitudinal edges;

wherein said base of said track wall has a pair of through bores;

wherein said pair of through bores in said track wall align with a pair of through bores in said base of said bracket; and wherein said pair of side walls of said track wall extend upwardly from said pair of longitudinal edges of said base of said track wall, respectively, so as to allow said track wall to have a generally and substantially U-shape in lateral cross section, wherein said track wall sits in said bracket so as to allow said bracket to capture said track wall.

2. The joints as defined in claim 1, wherein said base of said track wall abuts against said base of said bracket.

3. The joints as defined in claim 1, wherein said side walls of said track wall abut against said side walls of said bracket, respectively.

4. The joints as defined in claim 1; further comprising a base plate;

wherein said base plate sits in said bracket.

5. The joints as defined in claim 4, wherein said base plate abuts against said base of said track wall.

6. The joints as defined in claim 4, wherein said base plate has a pair of through bores;

wherein said pair of through bares in said base plate align with said pair of through bores in said base of said track wall, respectively; and wherein said pair of through bores in said base plate align with said pair of through bores in said base of said bracket, respectively.

7. The joints as defined in claim 6; further comprising a stud;

wherein said stud extends from said bracket.

8. The joints as defined in claim 7, wherein said stud has an end;

wherein said end of said stud abuts against said pair of side walls of said bracket;

wherein said end of said stud is affixed to said pair of side walls of said bracket;

wherein said end of said stud abuts against said base of said track wall when said base plate is not present so as to allow said base of said track wall to distribute the load of said stud to said bracket; and wherein said end of said stud abuts against said base plate when said base plate is present so as to allow said base plate to distribute the load of said stud to said track wall and ultimately to said bracket.

9. The joints as defined in claim 1, wherein one joint is an intermediate base joint;

wherein the substrate is a concrete foundation;

wherein said track wall extends outwardly from both ends of said base of said bracket;

wherein a pair of through bores in said base of said bracket, said pair of through bores in said track wall, and a pair of through bores in a base plate receive a pair of anchor bolts extending upwardly out of the concrete foundation;

wherein said anchor bolts have a pair of nuts, received thereon respectively;

wherein a stud extends centrally upwardly from said base plate so as to be straddled by said pair of nuts; and wherein said at least two diagonal braces are four, a pair of each extending from each side wall of said bracket, diagonally outwardly in opposite directions.

10. The joints as defined in claim 1, wherein one joint is an end base joint;

wherein the substrate is a concrete foundation;

wherein said track wall extends outwardly from an outermost end of said base of said bracket;

wherein only an outermost one of a pair of through bores in said base of said bracket, an aligned one of said pair of through bores in said track wall, and an aligned one of said pair of through bores in said base plate receive an anchor bolt extending upwardly out of the concrete foundation that has a nut received thereon;

wherein a stud extends upwardly from an outermost end of said base plate; and wherein said at least two diagonal braces extend diagonally inwardly.

11. The joints as defined in claim 1, wherein one joint is a ceiling and floor joint;

wherein the substrate is an upper header and a lower header that are spaced-apart by floor joists and a stud;

wherein two brackets are utilized;

wherein said base of one bracket is for abutting against said upper header;

wherein said base of the other bracket is for abutting against the lower header;

wherein said other bracket is in alignment with said one bracket;

wherein two track walls are utilized;

wherein one track wall extends outwardly from both ends of said base of said one bracket;

wherein the other track wall extends outwardly from both ends of said base of said other bracket;

wherein said through bores in said base of said one track wall, said pair of through bores in said base of said one bracket, a pair of through bores in the upper header, a pair of through bores in the lower header, said pair of through bores in said base of said other bracket, and said pair of through bores in said base of said other track wall receive a pair of through bolts;

wherein two studs are utilized;

wherein one stud extends centrally upwardly from said base of said one track wall so as to be straddled by said pair of through bolts;

wherein said one stud is aligned with the stud of the substrate;

wherein the other stud depends centrally from said base of said other track wall so as to be straddled by said pair of through bolts;

wherein the other stud is aligned with the stud of the substrate; and wherein said at least two diagonal braces are eight, a pair of each extend from each side wall of each bracket, diagonally outwardly in opposite directions.

12. The joints as defined in claim 1, wherein said base of said bracket has a said pair of through bores; and wherein said base of said bracket is for affixing to the substrate.

13. Joints for constructing a shear wall, comprising:

a bracket;

wherein said bracket is integrally formed with said shear wall;

wherein said bracket is for attaching said shear wall to a substrate; and wherein said bracket is for preventing uplift of said shear wall, wherein said bracket consists of:

a) a base; and b) a pair of side walls;

wherein said base of said bracket is for abutting against the substrate;

wherein said base of said bracket has a pair of longitudinal edges; and wherein said pair of side walls of said bracket extend upwardly from said pair of longitudinal edges of said base of said bracket, respectively, so as to allow said bracket to have a generally and substantially U-shape in lateral cross section; further comprising at least two diagonal braces;

wherein said at least two diagonal braces extend diagonally outwardly from said bracket, wherein each of said at least two diagonal braces abuts against a respective side wall of said bracket; and wherein each of said at least two diagonal braces is affixed to said respective side wall of said bracket.

14. Joints for constructing a shear wall, comprising:

a bracket;

wherein said bracket is integrally formed with said shear wall;

wherein said bracket is for attaching said shear wall to a substrate; and wherein said bracket is for preventing uplift of said shear wall, wherein said bracket consists of:

a) a base; and b) a pair of side walls;

wherein said base of said bracket is for abutting against the substrate;

wherein said base of said bracket has a pair of longitudinal edges; and wherein said pair of side walls of said bracket extend upwardly from said pair of longitudinal edges of said base of said bracket, respectively, so as to allow said bracket to have a generally and substantially U-shape in lateral cross section; further comprising at least two diagonal braces;

wherein said at least two diagonal braces extend diagonally outwardly from said bracket, wherein each of said at least two diagonal braces is flat.

15. Joints for constructing a shear wall, comprising:

a bracket;

wherein said bracket is integrally formed with said shear wall;

wherein said bracket is for attaching said shear wall to a substrate; and wherein said bracket is for preventing uplift of said shear wall, wherein said bracket consists of:

a) a base; and b) a pair of side walls;

wherein said base of said bracket is for abutting against the substrate;

wherein said base of said bracket has a pair of longitudinal edges; and wherein said pair of side walls of said bracket extend upwardly from said pair of longitudinal edges of said base of said bracket, respectively, so as to allow said bracket to have a generally and substantially U-shape in lateral cross section; further comprising at least two diagonal braces;

wherein said at least two diagonal braces extend diagonally outwardly from said bracket, wherein each of said at least two diagonal brace has an end; and wherein said end of each of said at least two diagonal braces has a plurality of through bores, wherein said plurality of through bores in said end of each of said at least two diagonal braces align with corresponding through bores in said respective side wall of said bracket.

* * * * *